US006043836A

United States Patent [19]

Kerr et al.

[11] Patent Number: 6,043,836

[45] Date of Patent: Mar. 28, 2000

[54] VACUUM DRUM WITH COUNTERSUNK HOLES

[75] Inventors: Roger S. Kerr, Brockport; Dean L. Smith, Pittsford; Douglas A. Hons, Rochester, all of N.Y.

[73] Assignee: Eastman Kodak Company, Rochester, N.Y.

[21] Appl. No.: 08/977,105

[22] Filed: Nov. 24, 1997

[51] Int. Cl.[7] ..... B41J 17/16

[52] U.S. Cl. ..... 347/262; 347/264; 347/215; 346/138; 101/389.1

[58] Field of Search ..... 347/215, 262, 347/264; 346/138; 399/305; 101/389.1

[56] References Cited

U.S. PATENT DOCUMENTS 4,437,659 3/1984 Caron et al. ..... 271/276
4,660,825 4/1987 Umezawa ..... 271/276
5,155,535 10/1992 Bermel et al. ..... 399/305
5,183,252 2/1993 Wolber et al. ..... 271/276
5,268,708 12/1993 Harshbarger et al. .
5,446,477 8/1995 Baek et al. ..... 346/138
5,486,932 1/1996 Leonard ..... 358/498
5,488,906 2/1996 Iron et al. ..... 101/477

*Primary Examiner*—N. Le
*Assistant Examiner*—Hai C. Pham
*Attorney, Agent, or Firm*—Nelson Adrian Blish; David A. Novais

[57] ABSTRACT

The present invention is for a vacuum drum (300) with countersunk holes (334). In one embodiment, vacuum holes (306), countersunk vacuum holes (334), and blind countersunk vacuum holes (336) on an outer surface of the vacuum drum are connected by vacuum grooves to facilitate holding multiple sheets of media on the vacuum drum (300), which revolves at high speeds.

30 Claims, 9 Drawing Sheets

VACUUM DRUM WITH COUNTERSUNK HOLES

FIELD OF THE INVENTION

This invention relates to an image processing apparatus, in general, and in particular, to a vacuum drum with countersunk vacuum holes, vacuum grooves, and blind countersunk holes to optimize system performance of vacuum imaging drums that revolves at high speeds.

BACKGROUND OF THE INVENTION

Pre-press color-proofing is a procedure that is used by the printing industry for creating representative images of printed material without the high cost and time that is required to actually produce printing plates and set up a high-speed, high volume, printing press to produce an example of an intended image. These representative images may require several corrections and be reproduced several times to satisfy the customer. Pre-press color-proofing saves time and money getting to an acceptable finished product.

An example of a commercially available image processing apparatus is shown in commonly assigned U.S. Pat. No. 5,268,708 and has half-tone color proofing capabilities. This image processing apparatus is arranged to form an intended image on a sheet of thermal print media in which dye from a sheet of dye donor material is transferred to the thermal print media by applying thermal energy to the dye donor material. The image processing apparatus is comprised generally of a material supply assembly or carousel, a lathe bed scanning subsystem (which includes a lathe bed scanning frame, translation drive, translation stage member, printhead, and vacuum imaging drum), and the thermal print media and dye donor material exit transports.

The operation of the image processing apparatus comprises metering a length of the thermal print media, in roll form, from the material assembly or carousel. The thermal print media is measured and cut into sheets of required length, transported to the vacuum imaging drum, registered and wrapped around and secured to the vacuum imaging drum. A length of dye donor material in roll form is metered out of the material supply assembly measured and cut into sheets of required length. The dye donor material is transported to and wrapped around the vacuum imaging drum, superposed and in registration with the thermal print media.

The thermal print media and the dye donor material are held on the spinning vacuum imaging drum by a vacuum and applied through holes in the surface of the drum while it is rotated past the printhead. The translation drive moves the printhead and translation stage member axially along the vacuum imaging drum in coordinated motion with the rotating vacuum imaging drum to produce the intended image on the thermal print media.

After the intended image has been written on the thermal print media, the dye donor material is removed from the vacuum imaging drum without disturbing the thermal print media beneath it. The dye donor material is transported out of the image processing apparatus by the dye donor material exit transport. Additional sheets of dye donor material, each a different color, are sequentially superimposed with the thermal print media on the vacuum imaging drum and imaged onto the thermal print media as described above, until the intended image is completed. The completed image on the thermal print media is unloaded from the vacuum imaging drum and transported to an external holding tray on the image processing apparatus by the exit transport.

The vacuum imaging drum is cylindrical in shape and includes a hollow interior portion. A plurality of holes extends through a surface of the drum applying a vacuum from the interior of the vacuum imaging drum, which maintains the position of the thermal print media and dye donor material as the vacuum imaging drum rotates.

The ends of the vacuum imaging drum are enclosed by cylindrical plates, each containing a centrally disposed spindle. The spindles extend through support bearings and are attached to the lathe bed scanning frame. The drive end spindle extends through the support bearing and is stepped down to receive a DC drive motor armature. The opposite spindle is provided with a central vacuum opening in alignment with a vacuum fitting with an external flange that is rigidly mounted to the lathe bed scanning frame. The vacuum fitting has an extension which is closely spaced with the vacuum spindle forming a small clearance. This configuration provides a slight vacuum leak between the outer diameter of the vacuum fitting and the inner diameter of the opening of the vacuum spindle. This assures that no contact exists between the vacuum fitting and the vacuum imaging drum which might impart uneven movement to the vacuum imaging drum during its rotation.

The opposite end of the vacuum fitting is connected to a high-volume vacuum blower which is capable of producing 50–60 inches of water (93.5–112.2 mm of mercury) at an air flow volume of 60–70 cfm (28.368–33.096 liters/sec). The vacuum required varies during the loading, scanning, and unloading of the thermal print media and the dye donor materials. With no media loaded on the vacuum imaging drum, the internal vacuum level of the vacuum imaging drum is approximately 10–15 inches of water (18.7–28.05 mm of mercury). With the thermal print media loaded on the vacuum imaging drum, the internal vacuum level of the vacuum imaging drum is approximately 20–25 inches of water (37.4–46.75 mm of mercury). This level is required when a dye donor material is removed, otherwise the thermal print media may move and color-to-color registration will not be maintained as dye donor material sheets are changed. With both the thermal print media and dye donor material completely loaded on the vacuum imaging drum, the internal vacuum level of the vacuum imaging drum is approximately 50–60 inches of water (93.5–112.2 mm of mercury).

The outer surface of the vacuum imaging drum is provided with an axially extending flat, which extends approximately 8° around the vacuum imaging drum circumference. The vacuum imaging drum is also provided with a circumferential recess which extends circumferentially from one side of the axially extending flat circumferentially around the vacuum imaging drum to the other side of the axially extending flat, and from approximately one inch (24.5 mm) from one end to approximately one inch (25.4 mm) from the other end of the vacuum imaging drum. The thermal print media, when mounted on the vacuum imaging drum, is seated in the circumferential recess. The circumferential recess has a depth substantially equal to the thermal print media thickness, approximately 0.004 inches (0.102 mm).

The purpose of the circumferential recess on the vacuum imaging drum surface is to eliminate any creases in the dye donor material as it is drawn down over the thermal print media during loading. This assures that no folds or creases will be generated in the dye donor material which could extend into the image area which would adversely affect the intended image. The circumferential recess also substantially eliminates the entrapment of air along the edge of the thermal print media where it is difficult for the vacuum holes in the vacuum imaging drum surface to assure the removal of the entrapped air. Any residual air between the thermal print media and the dye donor material can also adversely affect the intended image.

The purpose of the vacuum imaging drum axially extending flat assures that the leading and trailing ends of the dye donor material are protected from the effects of air drag during high speed rotation of the vacuum imaging drum during imaging process. Without the axially extending flat, the air drag tends to lift the leading or trailing edge of the dye donor material. The vacuum imaging drum axially extending flat also ensures that the leading and trailing ends of the dye donor material are recessed from the vacuum imaging drum periphery. This reduces the chance that the dye donor material contacting other parts of the image processing apparatus, such as the printhead, which may cause a jam, loss of the intended image, or catastrophic damage to the image processing apparatus.

The task of loading and unloading the dye donor material on the vacuum imaging drum requires precise positioning of thermal print media and the dye donor materials. The lead edge positioning of dye donor material must be accurately controlled during this process. The existing image processing apparatus design employs a multi-chambered vacuum imaging drum for such lead-edge control. One chamber applies vacuum to hold the leading edge of the dye donor material. Another chamber, separately valved, controls vacuum which holds the trailing edge of the thermal print media to the vacuum imaging drum. With this arrangement, loading a sheet of thermal print media and dye donor material requires that the image processing apparatus feed the lead edge of the thermal print media and dye donor material into position just past the vacuum ports controlled by the respective valved chamber. As vacuum is applied, the leading edge of the a dye donor material is pulled against the vacuum imaging drum surface.

Unloading the dye donor material, or the thermal print media, requires removal of vacuum from these same chambers so that an edge of the thermal print media, or the dye donor material, is freed and projects out from the surface of the vacuum imaging drum. The image processing apparatus then positions an articulating skive into the path of the free edge to lift the edge and to feed the dye donor material to a waste bin or the thermal print media to an output tray.

Although the image processing apparatus described is satisfactory, there is room for improvement. The technology utilized in the above image processing apparatus does not allow for large format thermal print media and dye donor material. Also throughput, the number of intended images per hour, is limited by the vacuum imaging drum rotational speed. (The faster the vacuum imaging drum rotates, the faster the output of the intended image can be exposed onto the thermal print media, thus increasing the throughput of the image processing apparatus.) At high rotational speeds, in excess of 1000 RPM, increased air turbulence and centrifugal force can separate the thermal print media and dye donor materials from each other and from the vacuum imaging drum, thus limiting the rotational speed of the vacuum imaging drum.

One approach to solving the above problem is adding external clamping components to hold the thermal print media and dye donor material on the vacuum imaging drum. This, however, adds increased cost and introduces added mechanical complexity to the vacuum imaging drum design. This solution may also cause the vacuum imaging drum to go out of round as much as 80 microns (0.0032 inches), which would not allow the image processing apparatus to meet image quality specifications. (The image processing apparatus tolerance requirement for focus is approximately 10 microns or 0.004 inches.) Clamping the thermal print media and dye donor material would also introduce a clearance problem since the working distance of the printhead to the surface of the thermal print media loaded on the vacuum imaging drum is approximately 0.030 inches (0.762 mm).

Another way to prevent the increased air turbulence and centrifugal force from separating the thermal print media and dye donor material from the rotating vacuum imaging drum is to add more vacuum holes to the surface of the vacuum imaging drum, or enlarge the diameter of the vacuum holes. This, however, would require an increase in the vacuum level in the interior of the vacuum imaging drum. A higher vacuum will increase the cost of the blower that produces the vacuum, requiring a complex vacuum coupling, adding mechanical noise to the rotation of the vacuum imaging drum, and increase customer operating cost by increasing electrical consumption. In addition, there is a limit to how high the vacuum level can be without distorting the media, which would decrease the quality of the intended image.

SUMMARY OF THE INVENTION

It is an object of the present invention to provide an increase in throughput of an image processing apparatus by increasing the rotational speed of the vacuum imaging drum.

It is an object of the present invention to provide an increase in throughput of the image processing apparatus without an increase in cost, size, or complexity of the image processing apparatus.

The present invention is directed at overcoming one or more of the problems set forth above. Briefly summarized, according to one aspect of the present invention a vacuum drum is comprised of a hollow metal cylinder closed at both ends and connected to a vacuum pump. The vacuum pump maintains a vacuum in the interior of the cylinder. Holes and countersunk holes in the surface of the cylinder hold thermal print media and dye donor material are superposed on the thermal print media to the surface. In one embodiment, blind countersunk holes are interspersed with the countersunk vacuum holes and connected to the countersunk vacuum holes by a series of grooves.

In another embodiment, an imaging processing apparatus for writing images to a thermal print media is comprised of a printhead, a lead screw for moving the printhead and a vacuum imaging drum for holding the thermal print media. The vacuum imaging drum has a plurality of vacuum holes in the surface of the drum, at least one of which is a countersunk vacuum hole.

The countersunk vacuum holes, vacuum grooves and vacuum holes translate the vacuum from the interior of the vacuum imaging drum to the surface of the vacuum imaging drum and thus to the thermal print media and the dye donor material, and is the mechanism that provides the force holding the thermal print media and the dye donor material to the surface of the vacuum imaging drum. The vacuum holes, countersunk vacuum holes, blind vacuum holes and vacuum grooves maintain the various vacuum levels in the interior of the vacuum imaging drum during the loading, scanning and unloading process. Prior art utilizes uniform cross-section vacuum hole configuration to supply vacuum to the surface of the vacuum imaging drum, and thus to the thermal print media and the dye donor material. Utilizing countersunk vacuum holes, vacuum grooves, and blind countersunk vacuum holes on the surface of the vacuum imaging drum increases the vacuum holding force that can be generated to hold the thermal print media and dye donor material on the surface of the vacuum imaging drum, while maintaining the vacuum level in the interior of the vacuum imaging drum. The air velocity, which is driven by the vacuum differential between the interior and the exterior of the vacuum imaging drum, attracts and holds the thermal print media and the dye donor material to the surface of the vacuum imaging drum. If larger diameter vacuum holes are used instead of the small countersunk vacuum holes, a larger air flow rate would be needed to obtain the required air velocity, this would, however, necessitate a larger vacuum blower. With the addition of the countersunk vacuum holes, vacuum grooves, and blind countersunk vacuum holes, the smaller diameter portion of the vacuum hole provides the necessary airflow, while the larger, or countersunk diameter, and the blind countersunk vacuum hole provide an increase in holding area for only the thermal print media and the dye donor. The blind countersunk vacuum holes connected to the countersunk vacuum holes by grooves also provide a vacuum reservoir. The various vacuum levels can also be increased or optimized. Without the countersunk vacuum holes, vacuum grooves, and blind countersunk vacuum holes, additional or larger diameter vacuum holes would be needed, requiring a higher vacuum level to hold the thermal print media and the dye donor material in contact with the surface of the vacuum imaging drum during the load, scanning and unloading process. Both of these options are undesirable since they increase the cost, size and noise of the image processing apparatus. By adding the countersunk vacuum holes, vacuum grooves, and blind countersunk vacuum holes to the surface of the vacuum imaging drum, a larger format thermal print media and dye donor material can be used while still maintaining the vacuum level in the interior of the vacuum imaging drum. The scanning or writing rotational speed of the vacuum imaging drum can thus be increased substantially, increasing the throughput of the image processing apparatus.

Although not described in detail, it would be obvious to someone skilled in the art that this invention can also be used in other applications such as vacuum plates, rollover rollers, hug drums for sheet and web transfer of media and internal drum, flat bed image processing apparatuses, and a single sheet image processing apparatus.

The above, and other objects, advantages, and novel features of the present invention will become more apparent from the accompanying detailed description thereof when considered in conjunction with the following drawings.

DETAILED DESCRIPTION OF THE INVENTION

The present description will be directed in particular to elements forming part of, or in cooperation more directly with the apparatus in accordance with the present invention. It is understood that elements not specifically shown or described may take various forms well-known to those skilled in the art.

Figure 1:
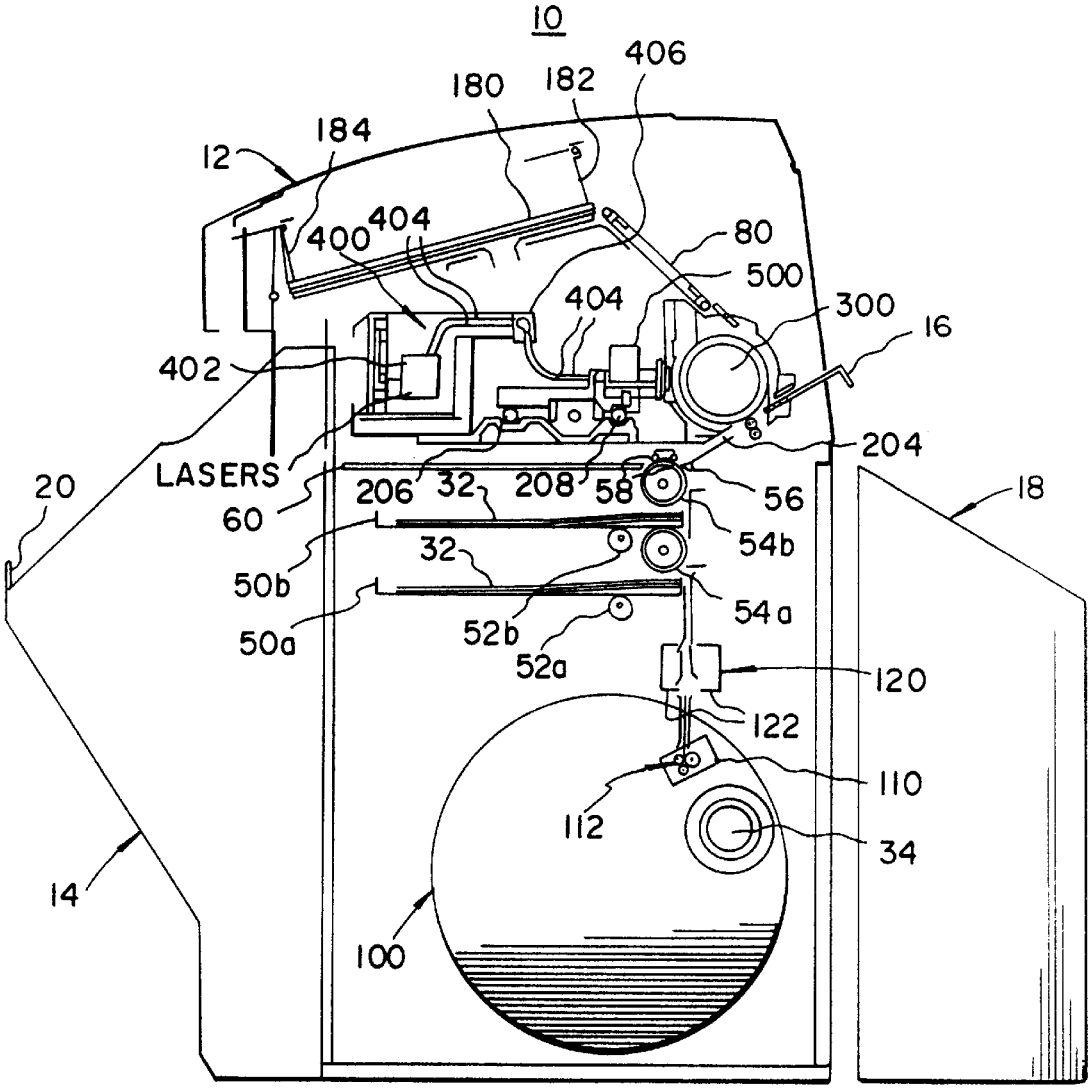
FIG. 1 is a side view in vertical cross-section of an image processing apparatus according to the present invention.

Referring to FIG. 1, there is illustrated an image processing apparatus 10 according to the present invention having an image processor housing 12 which provides a protective cover. A movable, hinged image processor door 14 is attached to the front portion of the image processor housing 12 permitting access to the two sheet material trays, lower sheet material tray 50*a* and upper sheet material tray 50*b*, that are positioned in the interior portion of the image processor housing 12 for supporting thermal print media 32. One of the sheet material trays will dispense the thermal print media 32 to create an intended image thereon; the alternate sheet material tray either holds an alternative type of 30 thermal print media or functions as a back-up sheet material tray. The lower sheet material tray 50*a* includes a lower media lift cam 52*a* for lifting the lower sheet material tray 50*a*, and ultimately the thermal print media 32, upwardly toward a rotatable, lower media roller 54*a* and toward a second rotatable, upper media roller 54*b* which, when both are rotated, permits the thermal print media 32 to be pulled upwardly toward a media guide 56. The upper sheet material tray 50*b* includes a upper media lift cam 52*b* for lifting the upper sheet material tray 50*b* and ultimately the thermal print media 32 towards the upper media roller 54*b* which directs it towards the media guide 56.

The movable media guide 56 directs the thermal print media 32 under a pair of media guide rollers 58 which engages the thermal print media 32 for assisting the upper media roller 54*b* in directing it onto the media staging tray 60. The media guide 56 is attached and hinged to the lathe bed scanning frame 202 at one end, and is uninhibited at its other end for permitting multiple positioning of the media guide 56. The media guide 56 then rotates its uninhibited end downwardly, as illustrated in the position shown, and the direction of rotation of the upper media roller 54*b* is reversed for moving the thermal print medium receiver sheet material 32 resting on the media staging tray 60 under the pair of media guide rollers 58, upwardly through an entrance passageway 204 and around a rotatable vacuum imaging drum 300.

A roll of dye donor material 34 is connected to the media carousel 100 in a lower portion of the image processor housing 12. Four rolls are used, but only one is shown for clarity. Each roll includes a dye donor material of a different color, typically black, yellow, magenta and cyan. These dye donor materials are ultimately cut into sheets and passed to the vacuum imaging drum 300 in registration with the thermal print media 32 described in more detail below. A media drive mechanism 110 is attached to each roll of dye donor material 34, and includes three media drive rollers 112 through which the dye donor material 34 of interest is metered upwardly into a media knife assembly 120. After the dye donor material 34 reaches a predetermined position, the media drive rollers 112 cease driving the dye donor material 34 and the two media knife blades 122 positioned at the bottom portion of the media knife assembly 120 cut the dye donor material 34 into sheets. The lower media roller 54*b* and the upper media roller 54*b* along with the media guide 56 then pass sheets of the dye donor material 36 onto the media staging tray 60 and ultimately to the vacuum imaging drum 300 and in registration with the thermal print media 32 using the same process described above. The dye donor material 36 now rests on top of the thermal print media 32 with a narrow gap between the two created by microbeads imbedded in the surface of the thermal print media 32.

A laser assembly 400 includes a quantity of laser diodes 402 connected via fiber optic cables 404 to a distribution block 406, and ultimately to the printhead 500. The printhead 500 directs thermal energy received from the laser diodes 402 to the dye donor material 36 to pass the desired color across the gap to the thermal print media 32. The printhead 500 is attached to a lead screw 250, shown in FIG. 2, via the lead screw drive nut 254 and drive coupling 256 (not shown) for permitting movement axially along the longitudinal axis of the vacuum imaging drum 300, for transferring image data to create the intended image onto the thermal print media 32.

For writing, the vacuum imaging drum 300 rotates at a constant velocity, and the printhead 500 begins at one end of the thermal print media 32 and traverse the entire length of the thermal print media 32 for completing the transfer process for the particular dye donor material 36 resting on the thermal print media 32. After the printhead 500 has completed the transfer process, for the particular dye donor material, the dye donor material 36 is removed from the vacuum imaging drum 300 and transferred out the image processor housing 12 via ejection chute 16. The dye donor material 36 eventually comes to rest in a waste bin 18 for removal by the user. The above-described process is repeated for the other three rolls of dye donor materials 34.

After the color from all four sheets of the dye donor material have been transferred and the dye donor material has been removed from the vacuum imaging drum 300, the thermal print media 32 is removed from the vacuum imaging drum 300 and transported via a transport mechanism 80 to a color binding assembly 180. The entrance door 182 of the color binding assembly 180 is opened for permitting the thermal print media 32 to enter the color binding assembly 180, and shuts once the thermal print media 32 comes to rest in the color binding assembly 180. The color binding assembly 180 processes the thermal print media 32 for further binding the transferred colors on the thermal print media 32 and for sealing the microbeads. After the color binding process has been completed, the media exit door 184 is opened and the thermal print media 32 with the intended image passes out of the color binding assembly 180 and the image processor housing 12 and comes to rest against a media stop 20.

Figure 2:
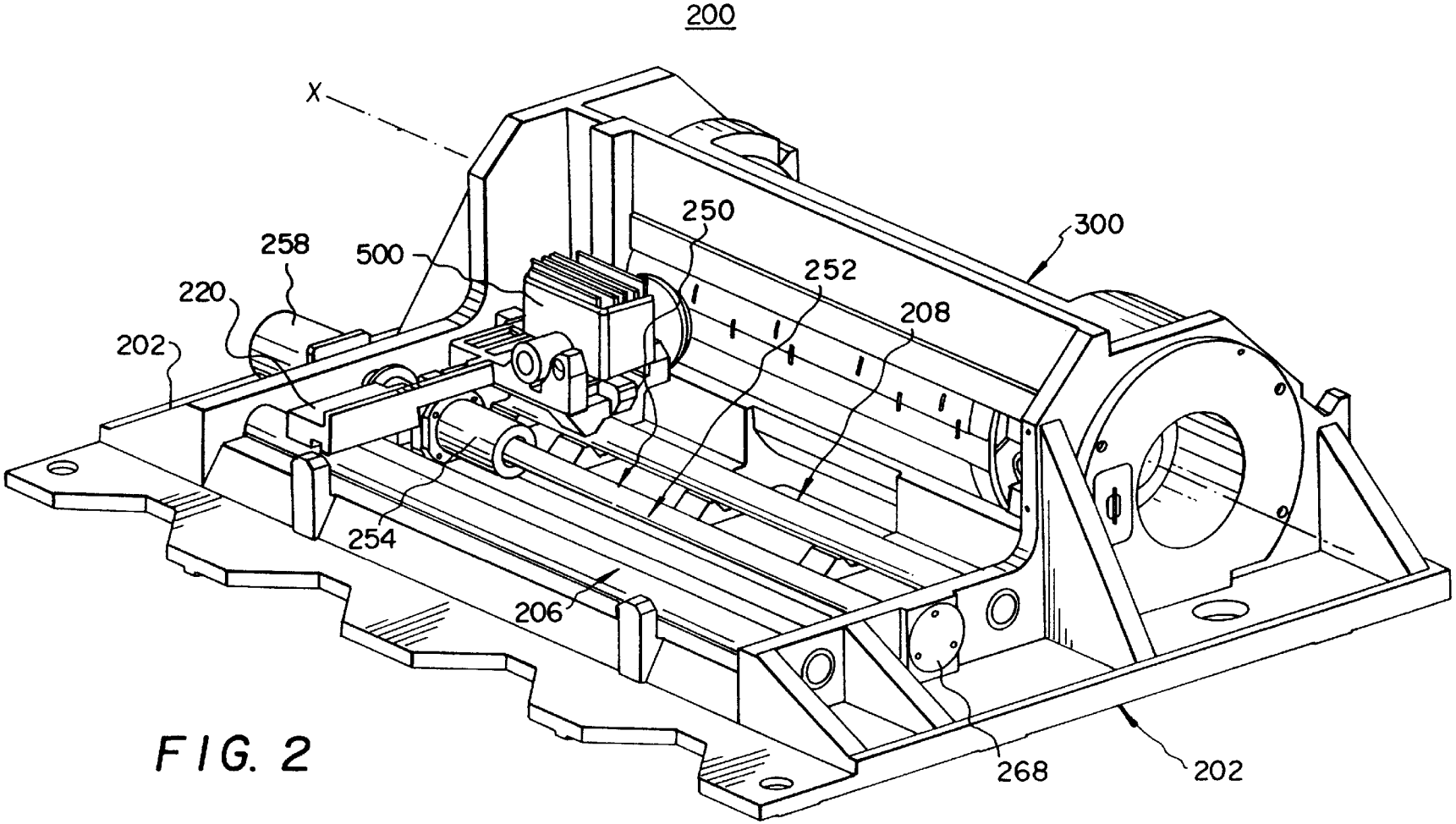
FIG. 2 is a perspective view of a lathe bed scanning subsystem of the present invention.

Referring to FIG. 2, there is illustrated a perspective view of the lathe bed scanning subsystem 200 of the image processing apparatus 10, including the vacuum imaging drum 300, printhead 500 and lead screw 250, all assembled in a lathe bed scanning frame 202. The vacuum imaging drum 300 is mounted for rotation about an axis X in the lathe bed scanning frame 202. The printhead 500 is movable with respect to the vacuum imaging drum 300, and is arranged to direct a beam of light to the dye donor material 36. The beam of light from the printhead 500 for each laser diode 402 (not shown in FIG. 2) is modulated individually by modulated electronic signals from the image processing apparatus 10, which are representative of the shape and color of the original image, so that the color on the dye donor material 36 is heated to cause volatilization only in those areas in which its presence is required on the thermal print media 32 to reconstruct the shape and color of the original image.

The printhead 500 is mounted on a movable translation stage member 220, which in turn, is supported for low friction slidable movement on translation bearing rods 206 and 208. The translation bearing rods 206 and 208 are sufficiently rigid so that they do not sag or distort between their mounting points and are arranged as parallel as possible with the axis X of the vacuum imaging drum 300 with the axis of the printhead 500 perpendicular to the axis X of the vacuum imaging drum 300 axis. The front translation bearing rod 208 locates the translation stage member 220 in the vertical and the horizontal directions with respect to axis X of the vacuum imaging drum 300. The rear translation bearing rod 206 locates the translation stage member 220 only with respect to rotation of the translation stage member 220 about the front translation bearing rod 208 so that there is no over-constraint condition of the translation stage member 220 which might cause it to bind, chatter, or otherwise impart undesirable vibration or jitters to the printhead 500 during the generation of an intended image.

Figure 3:
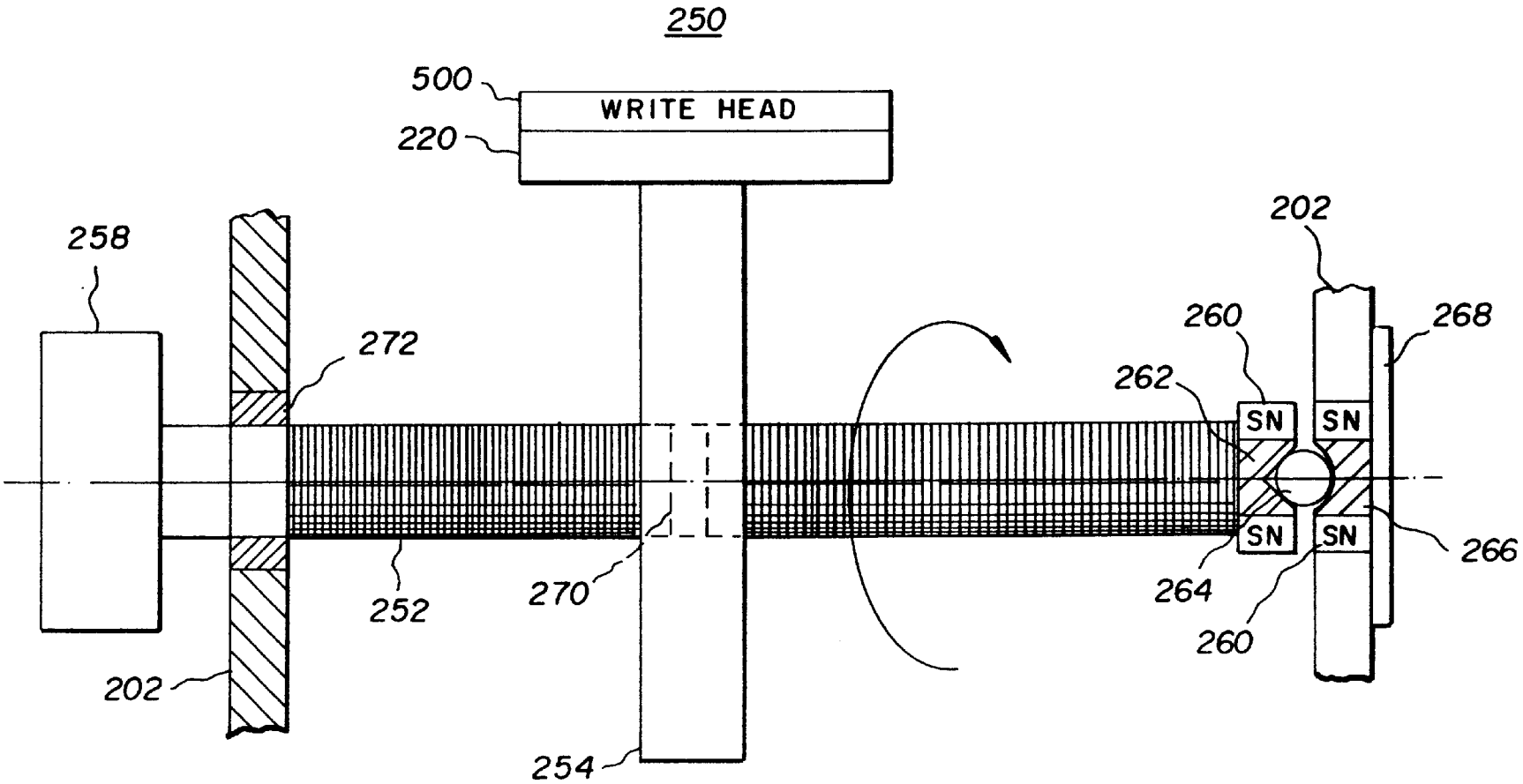
FIG. 3 is a plan view in horizontal cross-section, partially in phantom, of a lead screw according to the present invention.

Referring to FIGS. 2 and 3, a lead screw 250 is shown which includes an elongated, threaded shaft 252 which is attached to the linear drive motor 258 on its drive end and to the lathe bed scanning frame 202 by means of a radial bearing 272. A lead screw drive nut 254 includes grooves in its hollowed-out center portion 70 for mating with the threads of the threaded shaft 252 for permitting the lead screw drive nut 254 to move axially along the threaded shaft 252 as the threaded shaft 252 is rotated by the linear drive motor 258. The lead screw drive nut 254 is integrally attached to the to the printhead 500 through the lead screw coupling 256 (not shown) and the translation stage member 220 at its periphery so that as the threaded shaft 252 is rotated by the linear drive motor 258 the lead screw drive nut 254 moves axially along the threaded shaft 252 which in turn moves the translation stage member 220 and ultimately the printhead 500 axially along the vacuum imaging drum 300.

As best illustrated in FIG. 3, an annular-shaped axial load magnet 260*a* is integrally attached to the driven end of the threaded shaft 252, and is in a spaced apart relationship with another annular-shaped axial load magnet 260*b* attached to the lathe bed scanning frame 202. The axial load magnets 260*a* and 260*b* are preferably made of rare-earth materials such as neodymium-iron-boron. A generally circular-shaped boss 262, part of the threaded shaft 252, rests in the hollowed-out portion of the annular-shaped axial load magnet 260*a*, and includes a generally V-shaped surface at the end for receiving a ball bearing 264. A circular-shaped insert 266 is placed in the hollowed-out portion of the other annular-shaped axial load magnet 260*b*, and includes an accurate-shaped surface on one end for receiving the ball bearing 264, and a flat surface at its other end for receiving an end cap 268 placed over the annular-shaped axial load magnet 260*b* and attached to the lathe bed scanning frame 202 for protectively covering the annular-shaped axial load magnet 260*b* and providing an axial stop for the lead screw 250. The circular shaped insert 266 is preferably made of material such as Rulon J™ or Delrin AF™, both well known in the art.

The lead screw 250 operates as follows. The linear drive motor 258 is energized and imparts rotation to the lead screw 250, as indicated by the arrows, causing the lead screw drive nut 254 to move axially along the threaded shaft 252. The annular-shaped axial load magnets 260*a* and 260*b* are magnetically attracted to each other which prevents axial movement of the lead screw 250. The ball bearing 264, however, permits rotation of the lead screw 250 while maintaining the positional relationship of the annular-shaped axial load magnets 260, i.e., slightly spaced apart, which prevents mechanical friction between them while obviously permitting the threaded shaft 252 to rotate.

The printhead 500 travels in a path along the vacuum imaging drum 300, while being moved at a speed synchronous with the vacuum imaging drum 300 rotation and proportional to the width of the writing swath 450, not shown. The pattern that the printhead 500 transfers to the thermal print media 32 along the vacuum imaging drum 300 is a helix.

Figure 4:
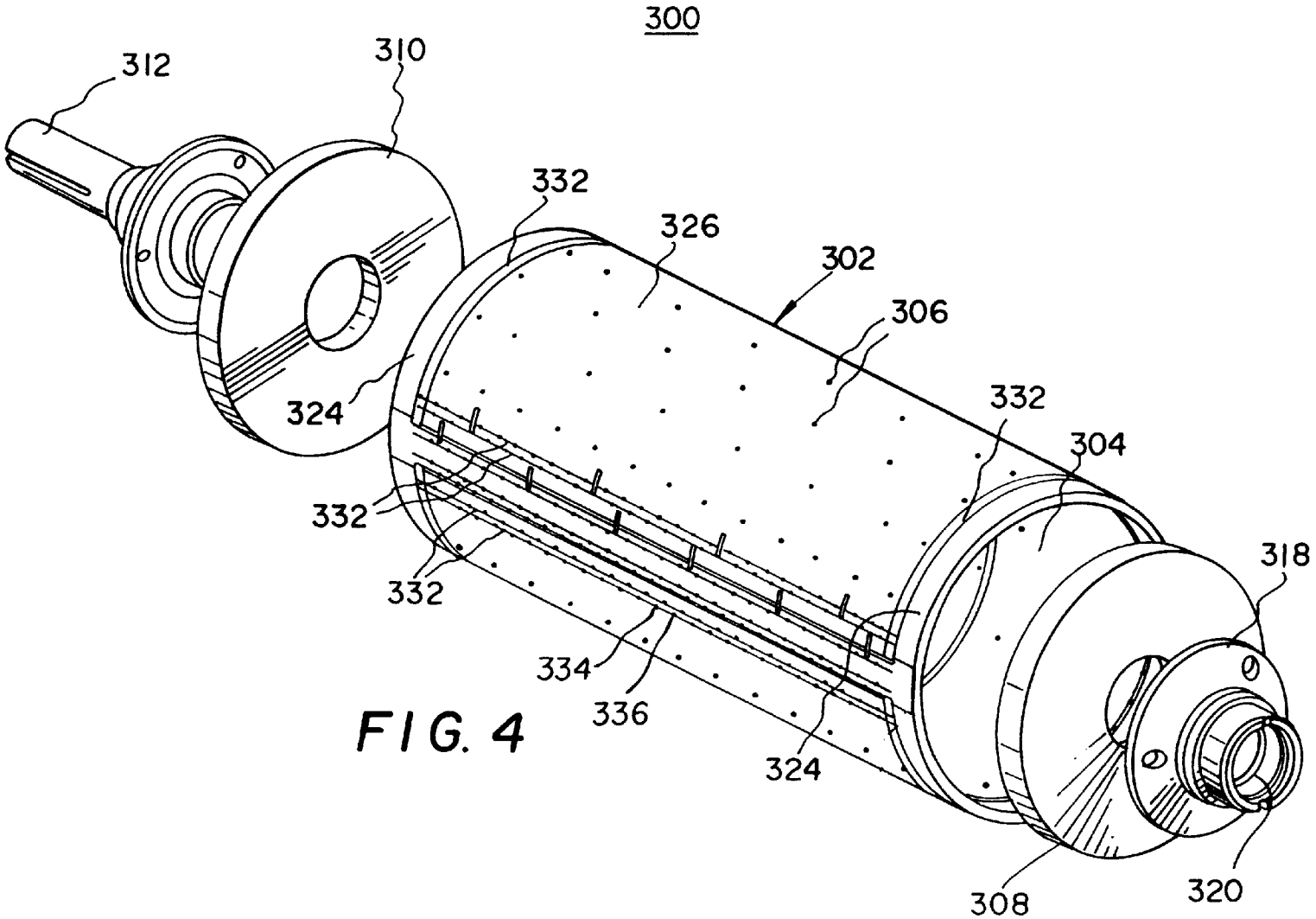
FIG. 4 is a exploded, perspective view of a vacuum imaging drum of the present invention.

Referring to FIG. 4, there is illustrated an exploded view of the vacuum imaging drum 300. The vacuum imaging drum 300 has a cylindrical-shaped vacuum drum housing 302 that has a hollowed-out interior portion 304, having a plurality vacuum holes 306 of uniform cross-section and countersunk vacuum holes 334, both of which extend through the vacuum drum housing 302 from the outside surface of the vacuum drum housing 302 for permitting a vacuum to be applied from the hollowed-out interior portion 304 of the vacuum imaging drum 300, and further includes on the outside surface of the vacuum drum housing 302 a plurality blind countersunk vacuum holes 336 to which vacuum is applied by means of vacuum groove 332 that is tied to the countersunk vacuum holes 334 (shown in FIG. 7 in more detail) for supporting and maintaining position of the thermal print media 32, and the dye donor material 36, to the vacuum imaging drum 300 during the load, scanning and unload process to create the intended image.

The ends of the vacuum imaging drum 300 are closed by the vacuum end plate 308, and the drive end plate 310. The drive end plate 310, is provided with a centrally disposed drive spindle 312 which extends outwardly therefrom through a support bearing 314, the vacuum end plate 308 is provided with a centrally disposed vacuum spindle 318 which extends outwardly therefrom through another support bearing 314.

The drive spindle 312 extends through the support bearing 314 and is stepped down to receive a DC drive motor armature 316 (not shown), which is held on by means of a drive nut 340 (not shown). A DC motor stator 342 is stationary held by the late bed scanning frame member 202, encircling the DC drive motor armature 316 to form a reversible, variable DC drive motor for the vacuum imaging drum 300. At the end of the drive spindle 312, a drum encoder 344 is mounted to provide the timing signals to the image processing apparatus 10.

The vacuum spindle 318 is provided with a central vacuum opening 320 which is in alignment with a vacuum fitting 222 with an external flange that is rigidly mounted to the lathe bed scanning frame 202. The vacuum fitting 222 has an extension which extends within, but is closely spaced from the vacuum spindle 318, thus forming a small clearance. With this configuration, a slight vacuum leak is provided between the outer diameter of the vacuum fitting 222 and the inner diameter of the central vacuum opening 320 of the vacuum spindle 318. This assures that no contact exists between the vacuum fitting 222 and the vacuum imaging drum 300 which might impart uneven movement or jitters to the vacuum imaging drum 300 during its rotation.

The opposite end of the vacuum fitting 222 is connected to a high-volume vacuum blower 224 which is capable of producing 50–60 inches of water (93.5–112.2 mm of mercury) at an air flow volume of 60–70 cfm (28.368–33.096 liters/sec). And provides the vacuum to the vacuum imaging drum 300 supporting the various internal vacuum levels of the vacuum imaging drum 300 required during the loading, scanning and unloading of the thermal print media 32 and the dye donor materials 36 to create the intended image. With no media loaded on the vacuum imaging drum 300 the internal vacuum level of the vacuum imaging drum 300 is approximately 10–15 inches of water (18.7–28.05 mm of mercury). With just the thermal print media 32 loaded on the vacuum imaging drum 300 the internal vacuum level of the vacuum imaging drum 300 is approximately 20–25 inches of water. This level is required such that when a dye donor material 36 is removed, the thermal print media 32 does not move, otherwise color-to-color registration will be able to be maintained. With both the thermal print media 32 and dye donor material 36 completely loaded on the vacuum imaging drum 300, the internal vacuum level of the vacuum imaging drum 300 is approximately 50–60 inches of water (93.5–112.2 mm of mercury) in this configuration.

Figure 5:
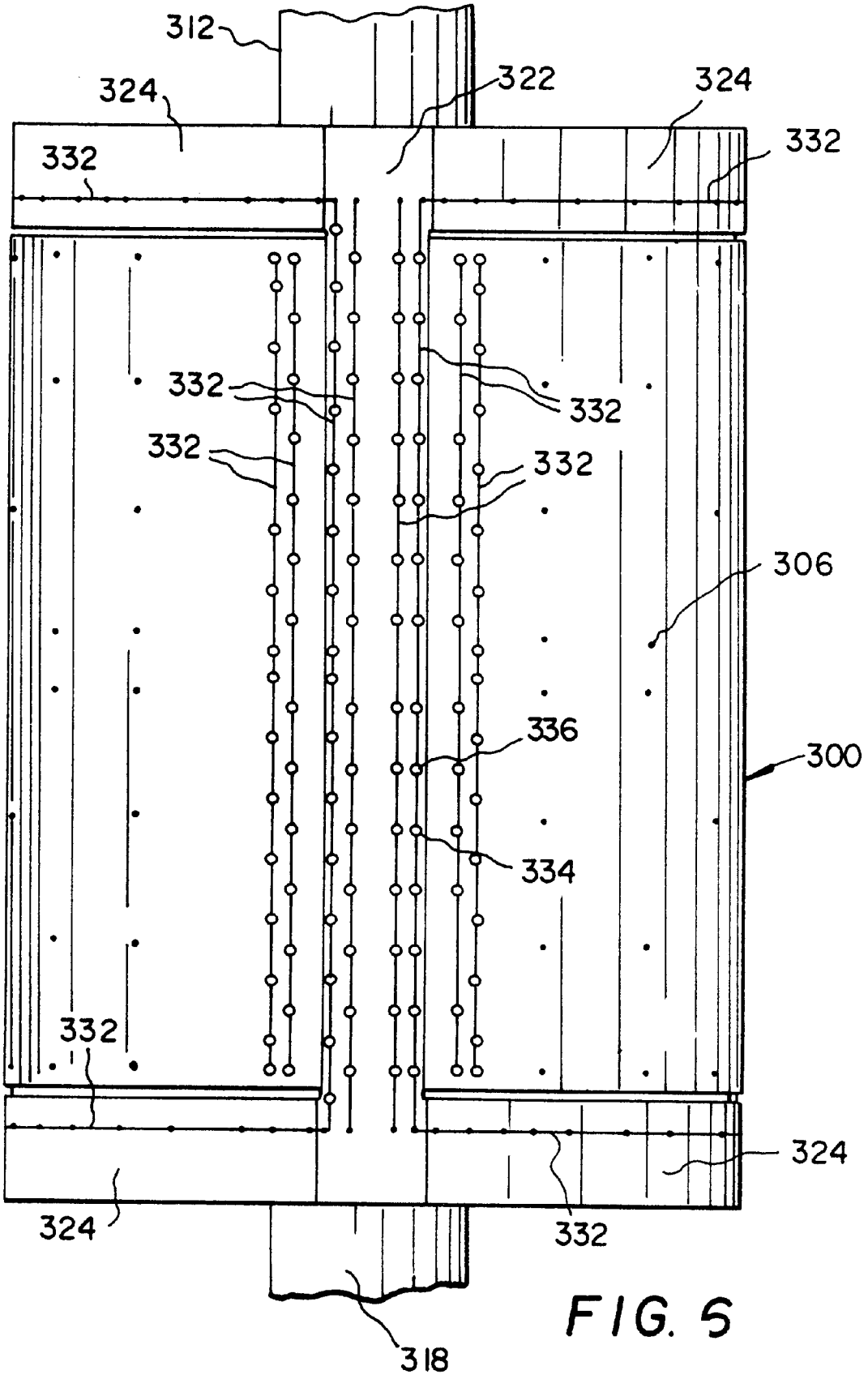
FIG. 5 is a plan view of the vacuum imaging drum surface according to the present invention.

The outer surface of the vacuum imaging drum 300 is provided with an axially extending flat 322, shown FIG. 5, which extends approximately 8° of the vacuum imaging drum 300 circumference. The vacuum imaging drum 300 is also provided with donor support rings 324 which form a circumferential recess 326 which extends circumferentially from one side of the axially extending flat 322 circumferentially around the vacuum imaging drum 300 to the other side of the axially extending flat 322, and from approximately one inch (25.4 mm) from one end of the vacuum imaging drum 300 to approximately one inch (25.4 mm) from the other end of the vacuum imaging drum 300.

Figure 6A:
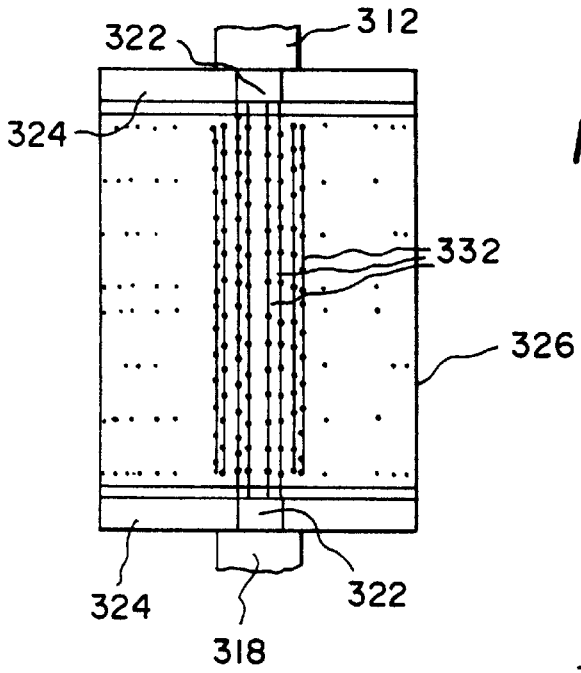
FIGS. 6*a*–6*c* is a plan view of the vacuum imaging drum showing the sequence of placement for the thermal print media and dye donor material.
Figure 6B:
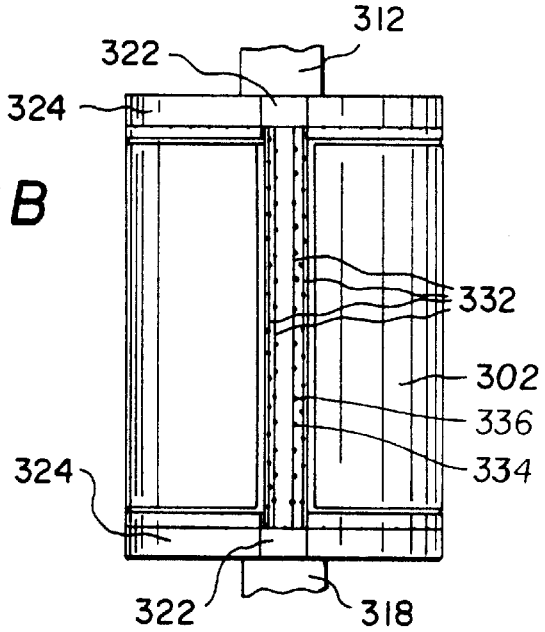
Figure 6C:
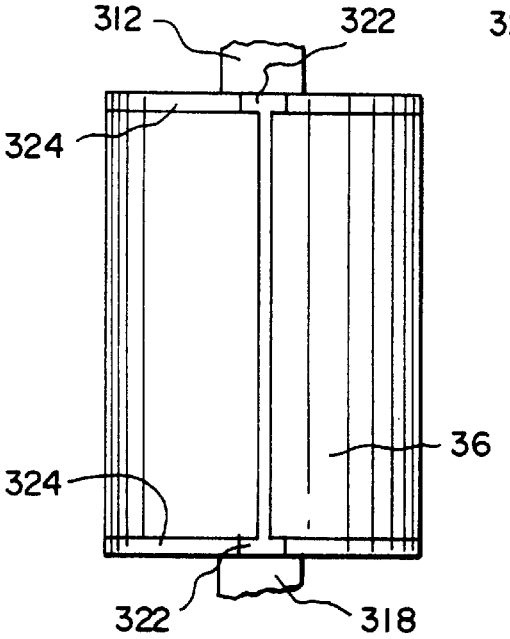

The thermal print media 32 is mounted on the vacuum imaging drum within the circumferential recess 326 as shown FIGS. 6*a* through 6*c*. The donor support rings 324 have a thickness substantially equal to the thermal print media 32 thickness seated therebetween which is approximately 0.004 inches (0.102 mm) in thickness. The purpose of the circumferential recess 326 on the vacuum imaging drum 300 surface is to eliminate any creases in the dye donor material 36, as they are drawn down over the thermal print media 32 during the loading of the dye donor material 36. This ensures that no folds or creases will be generated in the dye donor material 36 which could extend into the image area and seriously adversely affect the intended image. The circumferential recess 326 also substantially eliminates the entrapment of air along the edge of the thermal print media 32, where it is difficult for the vacuum holes 306 in the vacuum imaging drum 300 surface to assure the removal of the entrapped air. Any residual air between the thermal print media 32 and the dye donor material 36, can also adversely affect the intended image.

The axially extending flat 322 assures that the leading and trailing ends of the dye donor material 36 are some what protected from the effect of increased air turbulence during the relatively high speed rotation that the vacuum imaging drum 300 undergoes during the image scanning process. Thus, increased air turbulence will have less tendency to lift or separate the leading or trailing edges of the dye donor material 36 off from the vacuum imaging drum 300, also the axially extending flat 322 ensures that the leading and trailing ends of the dye donor material 36 are recessed from the vacuum imaging drum 300 periphery. This reduces the chance that the dye donor material 36 can come in contact with other parts of the image processing apparatus 10, such as the printhead 500. This could cause a media jam within the image processing apparatus, resulting in the possible loss of the intended image or at worse, catastrophic damage to the image processing apparatus 10 possibly damaging the printhead 500.

Figure 7:
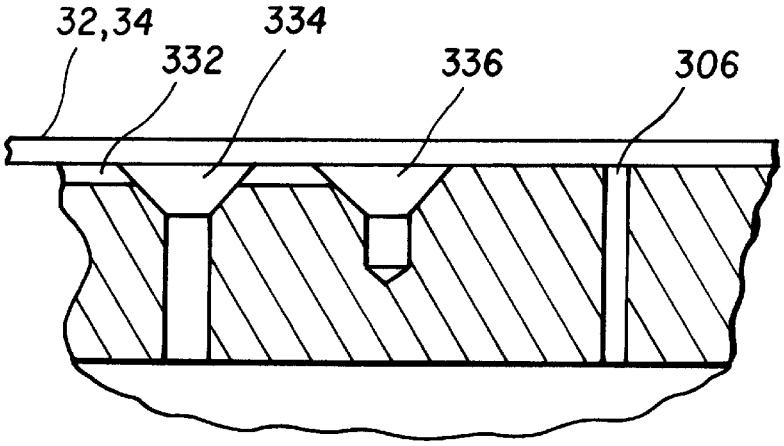
FIG. 7 is a partial section view of the vacuum imaging drum showing a countersunk vacuum hole, vacuum groove, and blind countersunk vacuum hole according to the present invention.

Referring to FIG. 7, there is illustrated a partial section view of the vacuum imaging drum 300 showing a vacuum hole 306 having a uniform cross-section, a countersunk vacuum hole 334 and a blind countersunk vacuum hole 336 that is tied to the countersunk vacuum hole 334 by vacuum groove 332. Vacuum is applied to the thermal print media 32 or dye donor material from the hollowed out interior portion of the vacuum imaging drum 300 through the various types of vacuum holes and grooves.

Figure 8:
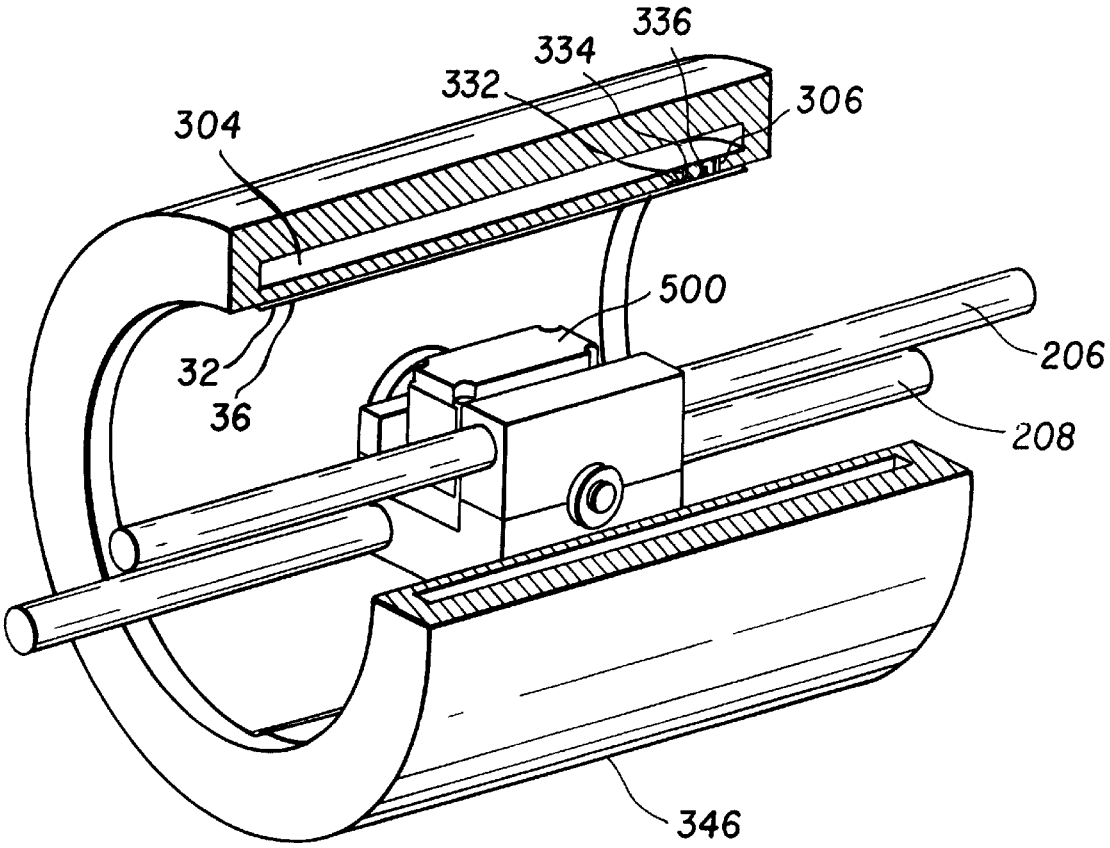
FIG. 8 is a perspective view of an internal vacuum imaging drum for an image processing apparatus according to the present invention.

Referring to FIG. 8, there is illustrated a perspective view of an internal vacuum imaging drum 346, of an image processing apparatus of another embodiment utilizing the present invention. A plurality of countersunk vacuum holes, blink countersunk holes and grooves similar to the embodiment described above, are located on an interior surface of vacuum imaging drum 346. In this embodiment, media would be deposited on the internal surface of the vacuum imaging drum.

Figure 9:
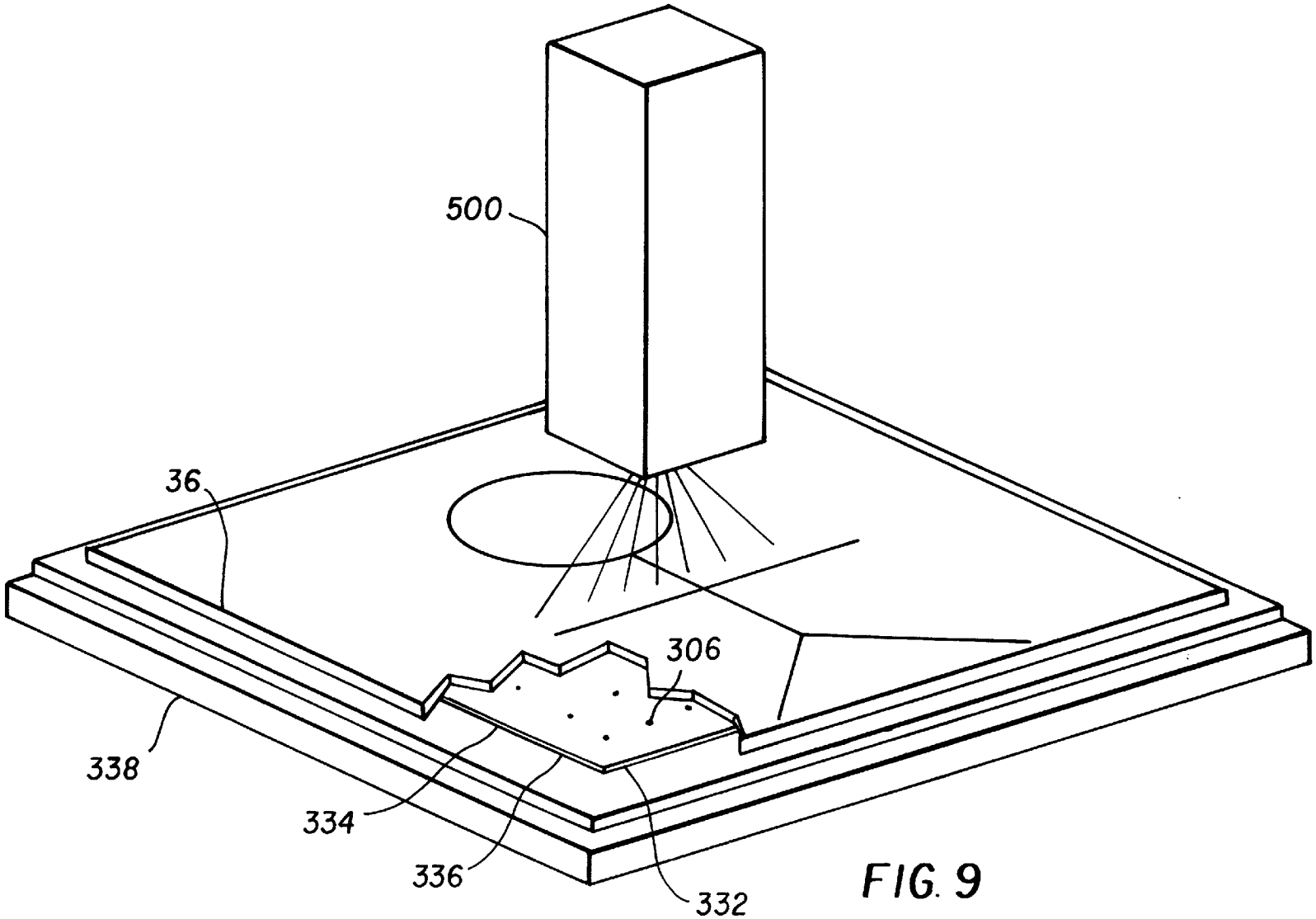
FIG. 9 is a perspective view of a flat bed image processing apparatus according to the present invention.

Referring to FIG. 9, there is illustrated a perspective view a flat bed vacuum plate 338, according to another embodiment utilizing the present invention. A series of countersunk vacuum holes 334, blind countersunk holes 336 and vacuum grooves 332 are arranged on a surface of vacuum plate 338 and performed as discussed in more detail above.

Figure 10:
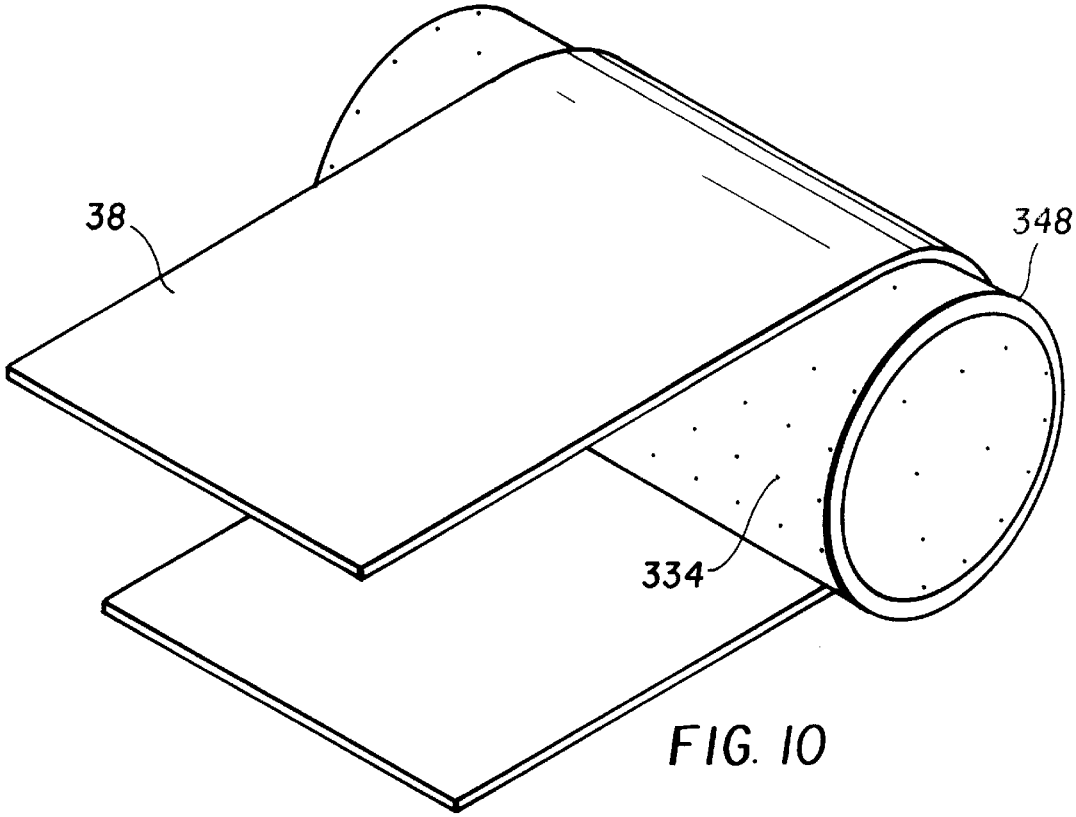
FIG. 10 is a perspective view of a vacuum rollover roller transporting sheet media of the present invention.

Referring to FIG. 10, there is illustrated a perspective view of a vacuum rollover roller 348 transporting sheet media 38, utilizing the present invention. A plurality of countersunk vacuum holes, blink countersunk holes and grooves similar to the embodiment described above, are located on an interior surface of vacuum imaging drum 346. In this embodiment, media would be deposited on the internal surface of the vacuum imaging drum.

Figure 11:
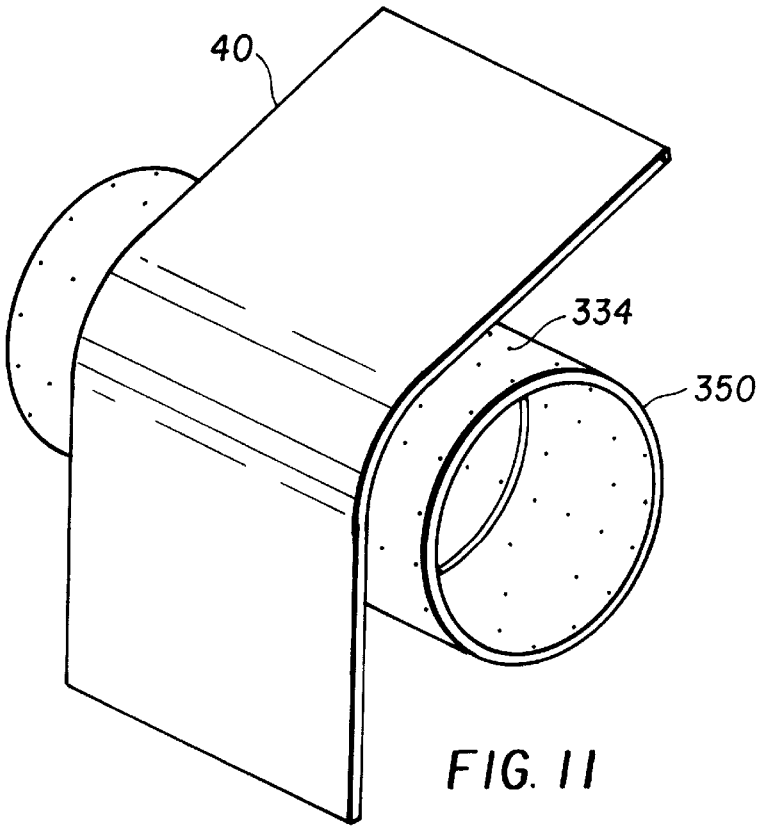
FIG. 11 is a perspective view of a vacuum hug drum transporting web media of the present invention.

Referring to FIG. 11, there is illustrated a perspective view of a vacuum hug drum 350 transporting web media 40, utilizing the present invention. A plurality of countersunk vacuum holes, blink countersunk holes and grooves similar to the embodiment described above, are located on an interior surface of vacuum imaging drum 346. In this embodiment, media would be deposited on the internal surface of the vacuum imaging drum.

An advantage of the present invention is that a wider range of media with different bend strengths and thickness can be used on the same vacuum imaging drum. Also, a wider range of thermal print media and dye donor material formats can be used without changing the vacuum system. Using the present invention, only minor changes to the vacuum imaging drum are required, and no additional changes required to the rest of the image processing apparatus are required.

An additional advantage of the present invention is that it can be used in other applications such as vacuum plates, rollover rollers, web transfer of media, internal drum imaging apparatus, and flat bed image processing apparatuses as described above.

A further advantage that the present invention is that only the surface of the vacuum imaging drum is modified with no appreciable change to the mass of the vacuum imaging drum or its mechanical characteristics, which minimizes distortion of the vacuum imaging drum at high rotational speeds. Thus, a dramatic increase in through put is achieved without changing blower design.

The invention has been described in detail with reference to certain preferred embodiments thereof, however, it is understood that variations and modifications can be effected within the scope of the claims by a person of ordinary skill in the art without departing from the scope of the invention. For example, the invention is applicable to any drum. Also, the dye donor may have dye, pigments, or other material which is transferred to the thermal print media. Print media includes, but is not limited to, paper, films, plates, and other material capable of accepting or producing an image. Although the countersunk holes and blind countersunk holes have a flared passage leading to the media surface, other shapes are also acceptable which have a larger opening adjacent to the media surface than on the vacuum side of the drum. Also while the embodiments have been discussed using a vacuum pump, or a blower, any acceptable means of drawing a vacuum can be used in the present invention. Light sources may include infrared, ultraviolet, visual and laser light.

PARTS LIST

10. Image processing apparatus
12. Image processor housing
14. Image processor door
16. Donor ejection chute
18. Donor waste bin
20. Media stop
30. Roll media
32. Thermal print media
34. Dye donor roll material
36. Dye donor material
38. Sheet media
40. Web media
50. Sheet material trays
50*a*. Lower sheet material tray
50*b*. Upper sheet material tray
52. Media lift cams
52*a*. Lower media lift cam
52*b*. Upper media lift cam
54. Media rollers
54*a*. Lower media roller
54*b*. Upper media roller
56. Media guide
58. Media guide rollers
60. Media staging tray
80. Transport mechanism
100. Media carousel
110. Media drive mechanism
112. Media drive rollers
120. Media knife assembly
122. Media knife blades
180. Color binding assembly
182. Media entrance door
184. Media exit door
200. Lathe bed scanning subsystem
202. Lathe bed scanning frame
204. Entrance passageway
206. Rear translation bearing rod
208. Front translation bearing rod
220. Translation stage member
222. Vacuum fitting
224. Vacuum blower
250. Lead screw

252. Threaded shaft
254. Lead screw drive nut
256. Drive coupling
258. Linear drive motor
260. Axial load magnets
260*a*. Axial load magnet
260*b* Axial load magnet
262. Circular-shaped boss
264. Ball bearing
266. Circular-shaped insert
268. End cap
270. Hollowed-out center portion
272. Radial bearing
300. Vacuum imaging drum
302. Vacuum drum housing
304. Hollowed out interior portion
306. Vacuum hole
308. Vacuum end plate
310. Drive end plate
312. Drive spindle
314. Support bearing
316. DC drive motor armature
318. Vacuum spindle
320. Central vacuum opening
322. Axially extending flat
324. Donor support ring
326. Circumferential recess
332. Vacuum grooves
334. Countersunk vacuum holes
336. Blind Countersunk vacuum holes
338. Vacuum plate
340. Drive nut
342. DC motor stator
344. Drum encoder
346. Internal vacuum imaging drum
348. Vacuum roll-over roller
350. Vacuum hug drum
400. Laser assembly
402. Lasers diode
404. Fiber optic cables
406. Distribution block
450. Writing swath
500. Printhead

What is claimed is:

1. A vacuum drum for holding material on a surface of said drum comprising:

a hollow metal cylinder closed at both ends;

a vacuum pump interfaced to at least one of said ends for drawing a vacuum on an interior of said cylinder at a predetermined level; and a plurality of countersunk vacuum holes in a surface of said cylinder which connect said interior of said cylinder to said surface, said plurality of countersunk vacuum holes permitting an increase in a holding force for the material while maintaining said vacuum at said predetermined level.

2. A vacuum drum as in claim 1 wherein said countersunk vacuum holes are connected by grooves.

3. A vacuum drum as in claim 1 wherein a plurality of blind countersunk holes are interspersed with said countersunk vacuum holes.

4. A vacuum drum as in claim 3 wherein said blind countersunk holes and said countersunk vacuum holes are connected by grooves.

5. A vacuum drum as in claim 1 wherein a motor is connected to one of said ends for rotating said vacuum drum.

6. A vacuum drum as in claim 1 wherein said vacuum pump is a blower.

7. A vacuum drum as in claim 1, wherein each of said countersunk vacuum holes has an opening which opens to a material on said surface of said drum, such that an area of said opening defines a holding area for the material.

8. An image processing apparatus for writing images to a print media comprising:

a printhead having a lead screw for moving said printhead;

a vacuum imaging drum wherein said media is mounted on said vacuum imaging drum;

a plurality of vacuum holes in a surface of said vacuum imaging drum, at least one of said vacuum holes being a countersunk vacuum hole for holding said print media on said vacuum imaging drum;

a motor for rotating said vacuum imaging drum; and wherein each of said countersunk vacuum holes has an opening which opens to media on the drum, such that an area of said opening defines a holding area for said media.

9. An image processing apparatus as in claim 8 wherein said print media is a thermal print media.

10. An image processing apparatus according to claim 8 wherein all of said vacuum holes are countersunk vacuum holes.

11. An image processing apparatus according to claim 8 wherein said vacuum holes are connected by grooves.

12. An image processing apparatus according to claim 8 wherein a plurality of blind countersunk holes are interspersed with said vacuum holes.

13. An image processing apparatus according to claim 12 wherein said blind countersunk holes and said vacuum holes are connected by grooves.

14. An image processing apparatus according to claim 8 wherein said image processing apparatus is a color-proofer.

15. An image processing apparatus according to claim 8 wherein said image processing apparatus is a laser thermal printer.

16. An image processing apparatus according to claim 8 wherein a dye donor material overlays said print media and said printhead writes an image to said print media by transferring a color from said dye donor material to said print media.

17. An image processing apparatus for writing images to a media comprising:

a printhead having at least one light source;

a lead screw for moving said printhead in a first direction;

a vacuum imaging drum;

vacuum holes, countersunk vacuum holes, and blind countersunk holes in a surface of said vacuum imaging drum, wherein said blind countersunk holes are connected to said countersunk vacuum holes by a vacuum groove to provide vacuum to the blind countersunk vacuum hole; and a motor for rotating said vacuum imaging drum.

18. An image processing apparatus according to claim 17 further comprising donor support rings which extend circumferentially around said vacuum imaging drum to accommodate multiple sizes of print media and dye donor materials.

19. An image processing apparatus according to claim 18 wherein said print media is covered by said dye donor material.

20. An image processing apparatus according to claim 18 wherein said dye donor material overlays said print media and said printhead writes an image to said print media by transferring a color from said dye donor material to said print media.

21. An image processing apparatus according to claim 17 wherein said image processing apparatus is a color-proofer.

22. An image processing apparatus according to claim 17 wherein said image processing apparatus is a laser thermal printer.

23. An image processing apparatus for writing images to a thermal print media comprising:

a printhead having at least one light source;

a lead screw for moving said printhead in a first direction;

an internal vacuum imaging drum;

vacuum holes in said internal vacuum imaging drum;

countersunk vacuum holes in said internal vacuum imaging drum;

blind countersunk holes in said internal vacuum imaging drum; and vacuum grooves connecting said blind countersunk hole to said countersunk vacuum holes.

24. An image processing apparatus for writing images to a print media comprising:

a printhead having a plurality of light sources;

a lead screw for moving said printhead;

a flat bed vacuum plate; and countersunk vacuum holes in a surface of said flat bed vacuum plate, and blind countersunk holes connected to said countersunk vacuum holes by means of a vacuum groove to provide vacuum to said blind countersunk vacuum holes.

25. A vacuum rollover roller for transporting sheet media wherein:

said vacuum rollover roller has vacuum holes and countersunk vacuum holes in a surface of said vacuum rollover roller, and at least a portion of said countersunk vacuum holes are blind countersunk holes connected to said countersunk vacuum holes by means of a vacuum groove to provide vacuum to said blind countersunk vacuum holes.

26. A vacuum hug drum for transporting web media wherein said vacuum hug drum has vacuum holes and countersunk vacuum holes, and at least a portion of said countersunk vacuum holes are blind countersunk vacuum holes connected to said countersunk vacuum holes by means of a vacuum groove to provide vacuum to said blind countersunk vacuum holes.

27. An image processing apparatus for receiving a medium for forming an image thereon, said image processor comprising:

a vacuum imaging drum having a hollow interior, mounted for rotation about an axis and arranged to mount a receiver medium and donor medium in superimposed relationship thereon, said receiver medium having a first length and width and said donor medium having a second length and width greater than said receiver medium;

means for providing a vacuum to the interior of said vacuum imaging drum, said vacuum imaging drum having a first set of receiver medium countersunk vacuum holes and a second set of donor medium countersunk vacuum holes, said first and second sets of countersunk vacuum holes extending from said interior of said vacuum imaging drum, to a surface of said vacuum imaging drum for applying vacuum from said interior to maintain said donor medium and said receiver medium on said vacuum imaging drum during rotation of said vacuum imaging drum;

an axial extending planar area disposed in said surface of said vacuum imaging drum arranged to accept a leading edge and a trailing edge of said donor medium; and a receiver medium circumferential recess on said surface of said vacuum imaging drum arranged such that said leading and said trailing edges of said donor medium overlie opposite edges of said planar area without over lapping each other;

said vacuum imaging drum having donor support rings which form said receiver medium circumferential recess on the surface of said vacuum imaging drum.

28. An imaging processing apparatus according to claim 27 wherein said circumferential recess contains substantially all of said first set of countersunk vacuum holes in said vacuum imaging drum.

29. An image processing apparatus according to claim 27 wherein said countersunk vacuum holes have a first diameter portion which restricts airflow, and a second diameter portion, larger than said first diameter portion, is in contact with said receiver medium.

30. An image processing apparatus according to claim 27, wherein each of said first set and said second set of countersunk vacuum holes open to medium on said drum, such that an area of said opening defines a holding area for said medium.

* * * * *